US008277190B2

(12) United States Patent
Piersall et al.

(10) Patent No.: US 8,277,190 B2
(45) Date of Patent: Oct. 2, 2012

(54) TURBOMACHINE ROTOR ASSEMBLY AND METHOD

(75) Inventors: Matthew Robert Piersall, Greenville, SC (US); Brian Denver Potter, Greer, SC (US)

(73) Assignee: General Electric Company, Schenectady, NY (US)

( * ) Notice: Subject to any disclaimer, the term of this patent is extended or adjusted under 35 U.S.C. 154(b) by 617 days.

(21) Appl. No.: 12/412,969

(22) Filed: Mar. 27, 2009

(65) Prior Publication Data

US 2010/0247317 A1 Sep. 30, 2010

(51) Int. Cl.
*F01D 5/30* (2006.01)

(52) U.S. Cl. ..... 416/219 R; 416/215; 416/216; 416/214 A; 416/210 R

(58) Field of Classification Search ..... 416/215, 416/216, 219 R, 214 A, 210 R
See application file for complete search history.

(56) References Cited

U.S. PATENT DOCUMENTS

| | | | |
|---|---|---|---|
| 3,826,592 | A | 7/1974 | Raboin |
| 4,655,687 | A | 4/1987 | Atkinson |
| 4,781,532 | A | 11/1988 | Novacek et al. |
| 5,435,693 | A | 7/1995 | Shaffer |
| 6,726,452 | B2 | 4/2004 | Strassberger et al. |
| 6,739,837 | B2 | 5/2004 | Barnette et al. |
| 6,755,618 | B2 | 6/2004 | Munshi et al. |
| 7,300,253 | B2 | 11/2007 | Beeck et al. |

*Primary Examiner* — Long Pham
(74) *Attorney, Agent, or Firm* — Cantor Colburn LLP

(57) ABSTRACT

Disclosed is a rotor assembly for a turbomachine includes a disk having a first axial face and a second axial face. The disk includes at least one circumferential dovetail extending around an outer surface of the disk and a plurality of axial dovetails extending from the first axial face to the second axial face. Each blade of a plurality of blades is installed into an axial dovetail of the plurality of axial dovetails and each platform of a plurality of platforms is installed adjacent to a blade of the plurality of blades via the at least one circumferential dovetail. Further disclosed is a method of assembly of a rotor for a turbomachine.

9 Claims, 8 Drawing Sheets

TURBOMACHINE ROTOR ASSEMBLY AND METHOD

BACKGROUND OF THE INVENTION

The subject matter disclosed herein relates to turbomachinery. More specifically, the subject disclosure relates to attachment of turbomachine blades and platforms to the turbomachine.

In a typical turbomachine (a gas turbine, steam turbine or the like), work is added to or extracted from a working fluid via one or more rows of blades or buckets, hereinafter referred to as blades. The rows of blades, which may be located in either or both of a compressor section and a turbine section of the turbomachine, are typically fixed to a wheel which is rotatable around a central axis of the turbomachine. The blades are located and secured to the wheel by inserting a base portion of individual blades which are configured with a dovetail shape into a corresponding dovetail slot in the wheel.

The blades of the typical turbomachine include an integral platform extending from the base of blade. When the blades are installed on the wheel, the platforms define an inner flowpath of the turbomachine. Design of the blade and platform are constrained by stresses on the airfoil shape during operation of the turbomachine, and materials for a blade casting are chosen to withstand those stresses. As a consequence, the platform area, which is subject to lower levels of stress, is often over-robust because of the material chosen, and as a result more costly and heavier than necessary. Further, the airfoil is subjected to different thermal boundary conditions than the platform and a thermal fight results from the one-piece airfoil and platform configuration thus increasing stresses on the component.

BRIEF DESCRIPTION OF THE INVENTION

According to one aspect of the invention, a rotor assembly for a turbomachine includes a disk having a first axial face and a second axial face. The disk includes at least one circumferential dovetail extending around an outer surface of the disk and a plurality of axial dovetails extending from the first axial face to the second axial face. Each blade of a plurality of blades is installed into an axial dovetail of the plurality of axial dovetails and each platform of a plurality of platforms is installed adjacent to a blade of the plurality of blades via the at least one circumferential dovetail.

According to another aspect of the invention, a method of assembly of a rotor for a turbomachine includes alternatingly installing platforms of a plurality of platforms onto at least one circumferential dovetail of a disk and installing blades of a plurality of blades into a dovetail slot of a plurality of dovetail slots in the disk until a last platform of the plurality of platforms is installed on the disk. A last blade of the plurality of blades is inserted into a dovetail slot between a first platform and the last platform, thereby locking circumferential positions of the plurality of blades and the plurality of platforms.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
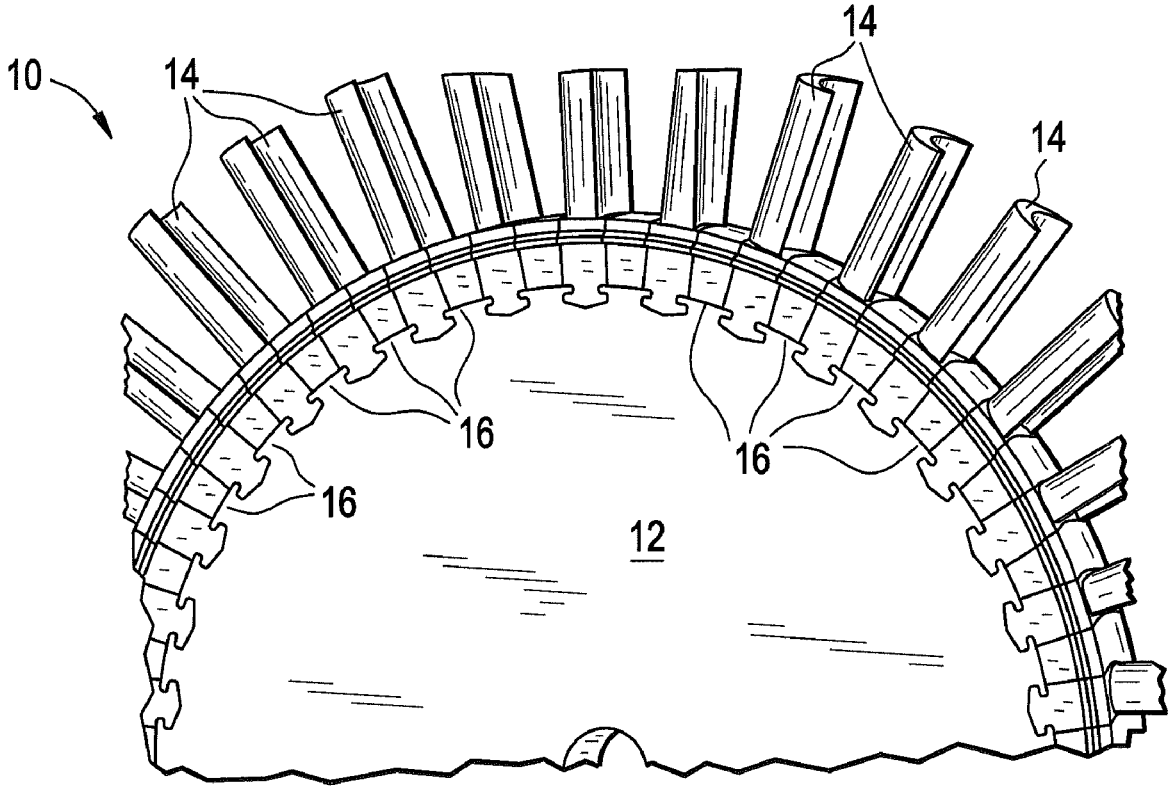
FIG. 1 is a perspective view of an embodiment of a rotor assembly for a turbomachine.

Shown in FIG. 1 is a rotor assembly 10 for a turbomachine. The rotor assembly 10 shown is a turbine rotor assembly, but it is to be appreciated that the following description may be also applied to a compressor rotor assembly, or similar structure. The rotor assembly 10 includes a wheel 12 and a plurality of blades 14 are arranged around the perimeter of the wheel 12 and are affixed thereto. The rotor assembly 10 further includes a plurality of platforms 16, with a platform 16 installed between adjacent blades 14 of the plurality of blades 14.

Figure 2:
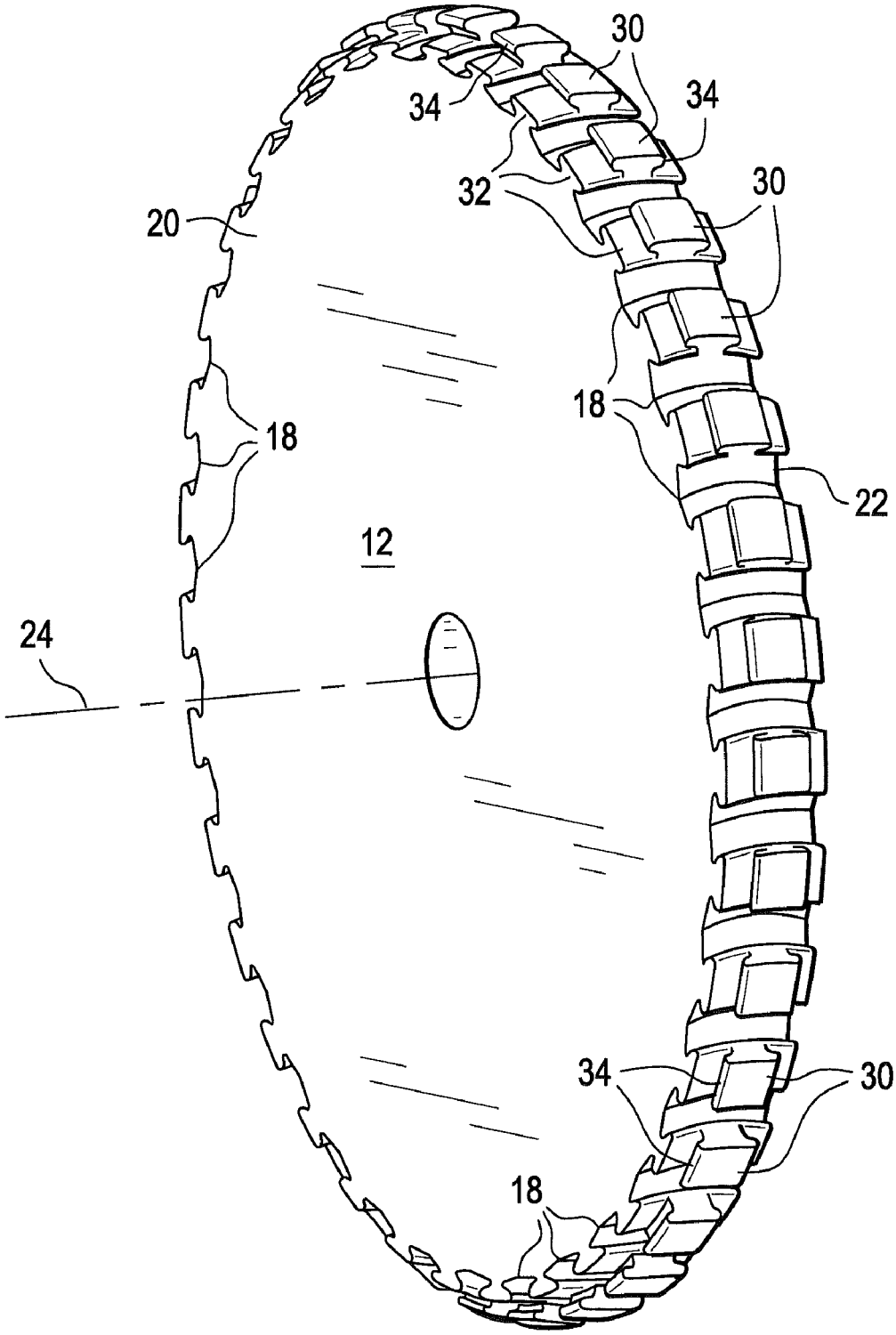
FIG. 2 is a perspective view of an embodiment of a wheel of the rotor assembly of FIG. 1.
Figure 3:
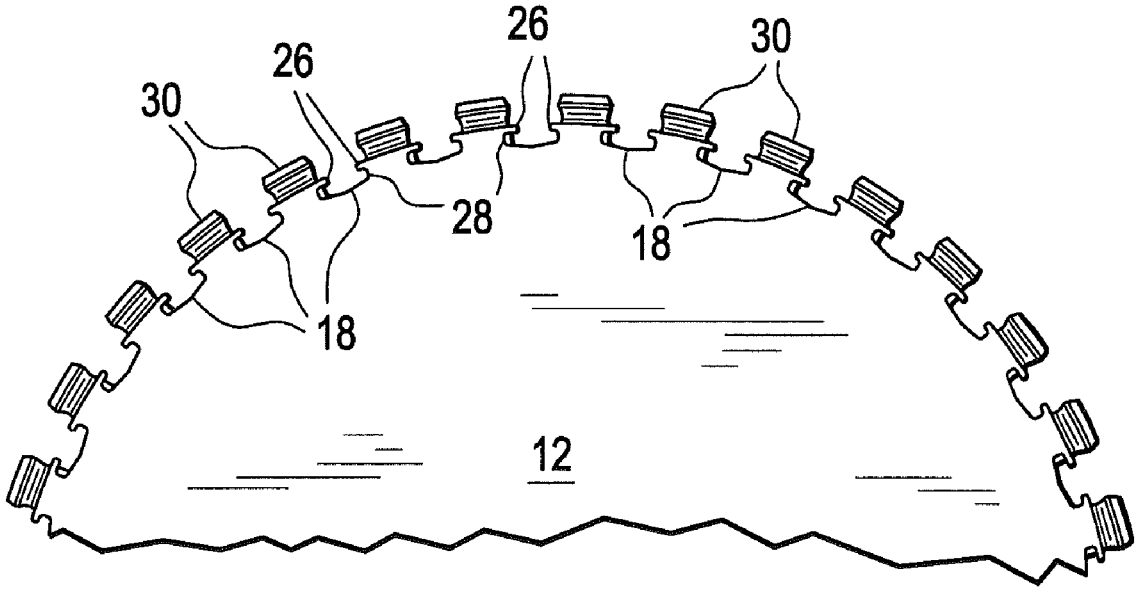
FIG. 3 is a partial view of the wheel of FIG. 2.

Referring now to FIG. 2, the wheel 12 includes a plurality of dovetail slots 18. Each dovetail slot 18 extends through the wheel 12 from a first face 20 to a second face 22 of the wheel 12. In some embodiments, as shown in FIG. 2, the dovetail slots 18 extend substantially in a direction parallel to a central axis 24 of the wheel 12 from the first face 20 to the second face 22. It is to be appreciated, though, that other configurations of dovetail slots 18 are contemplated by the present disclosure. For example, the dovetail slots 18 may be skewed to the central axis 24 and/or curved along the length of the dovetail slot 18 from the first face 20 to the second face 22. Further, as best shown in FIG. 3, each dovetail slot 18 includes at least one axial tang 26 which extends into the dovetail slot 18 from a slot wall 28. The embodiment illustrated in FIG. 3 includes two axial tangs 26, one extending from each slot wall 28, but it is to be appreciated that other quantities of axial tangs 26, for example, four or six axial tangs 26, may be utilized.

Referring again to FIG. 2, the wheel 12 includes a plurality of circumferential dovetails 30. The circumferential dovetails 30 are arranged around the perimeter of the wheel 12 at an outer surface 32 of the wheel 12. The plurality of circumferential dovetails 30 of FIG. 2 extend radially outwardly from the outer surface 32 and include one or more circumferential tangs 34. While a single circumferential tang 34 is illustrated in each circumferential dovetail 30 of FIG. 2, it is to be appreciated that additional quantities of circumferential tangs 34, for example, two or three circumferential tangs 34, may be utilized. Further, while the embodiment of FIG. 2 shows the circumferential dovetails 30 extending radially outwardly from the outer surface 32, the circumferential dovetails 30 may be configured to extend radially inwardly resulting in a slot configuration.

Figure 4:
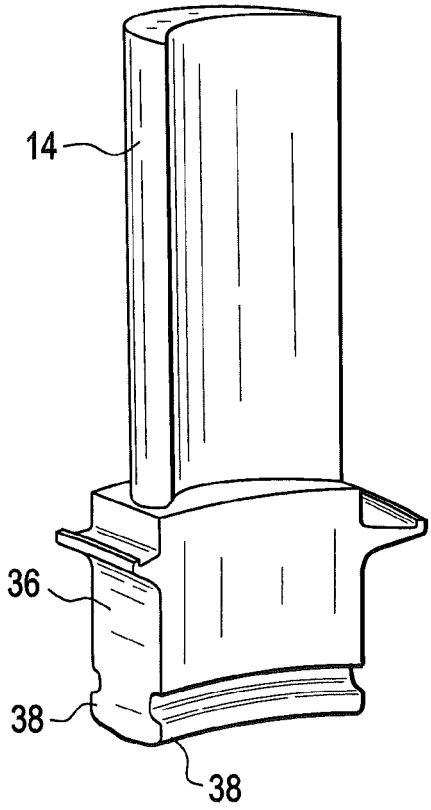
FIG. 4 is a perspective view of an embodiment of a blade of the rotor assembly of FIG. 1.
Figure 5:
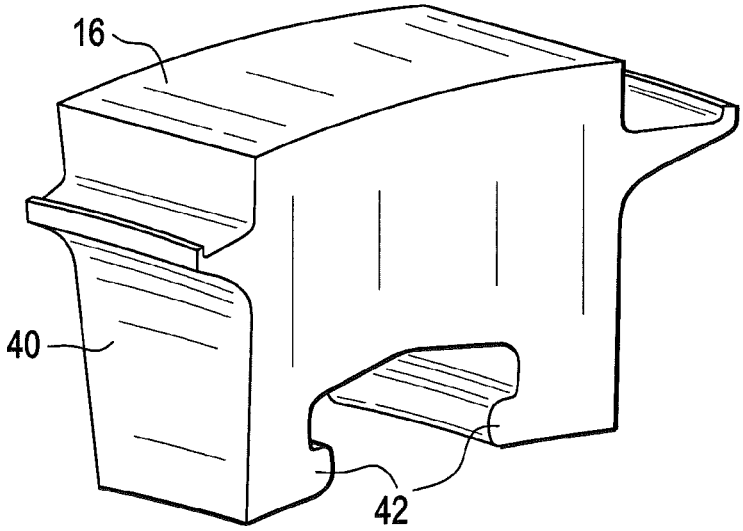
FIG. 5 is a perspective view of an embodiment of a platform of the rotor assembly of FIG. 1.

As shown in FIG. 4, each blade 14 of the plurality of blades 14 includes a blade dovetail 36. The blade dovetail 36 includes at least one blade tang 38 and is configured to be insertable into a dovetail slot 18 of the plurality of dovetail slots 18. In this way each blade 14 is circumferentially and radially positioned in the wheel 12. Referring now to FIG. 5, each platform 16 of the plurality of platforms 16 includes a platform dovetail 40 having at least one platform tang 42. The at least one platform tang 42 is configured to be complimentary to the circumferential tangs 34 of the circumferential dovetail 30 so that each platform 16 will be positioned axially and radially in the wheel 12.

Figure 6:
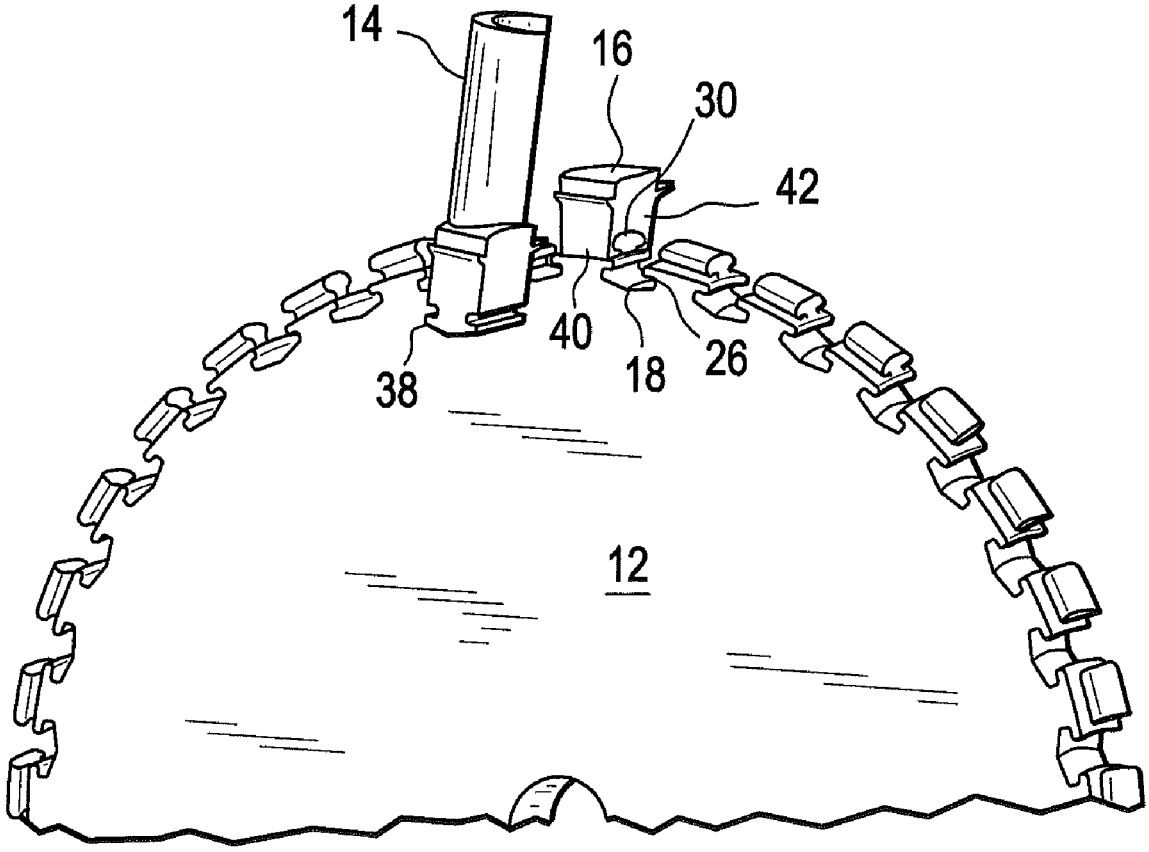
FIG. 6 is a perspective view of the rotor assembly of FIG. 1 having only a platform installed on the wheel.
Figure 7:
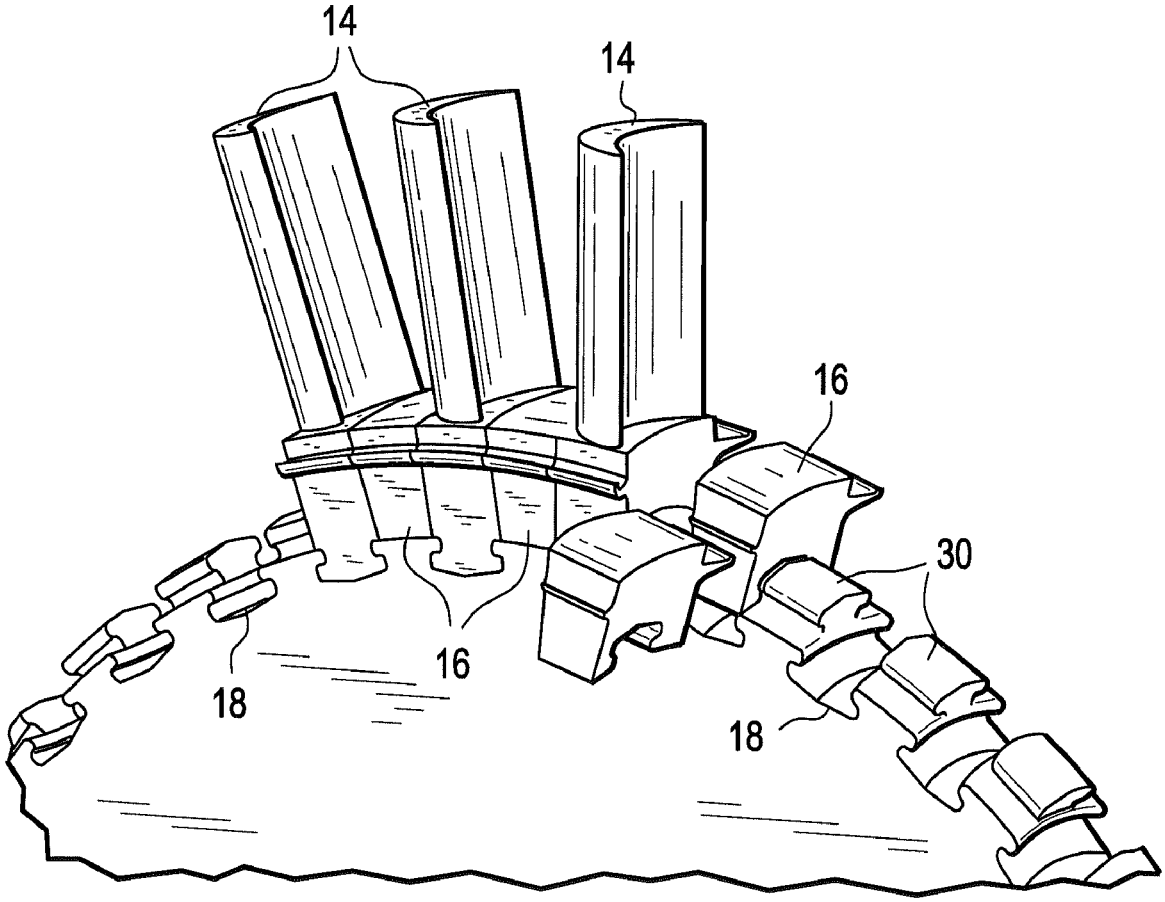
FIG. 7 is a perspective view of a partially assembled rotor assembly of FIG. 1.
Figure 8:
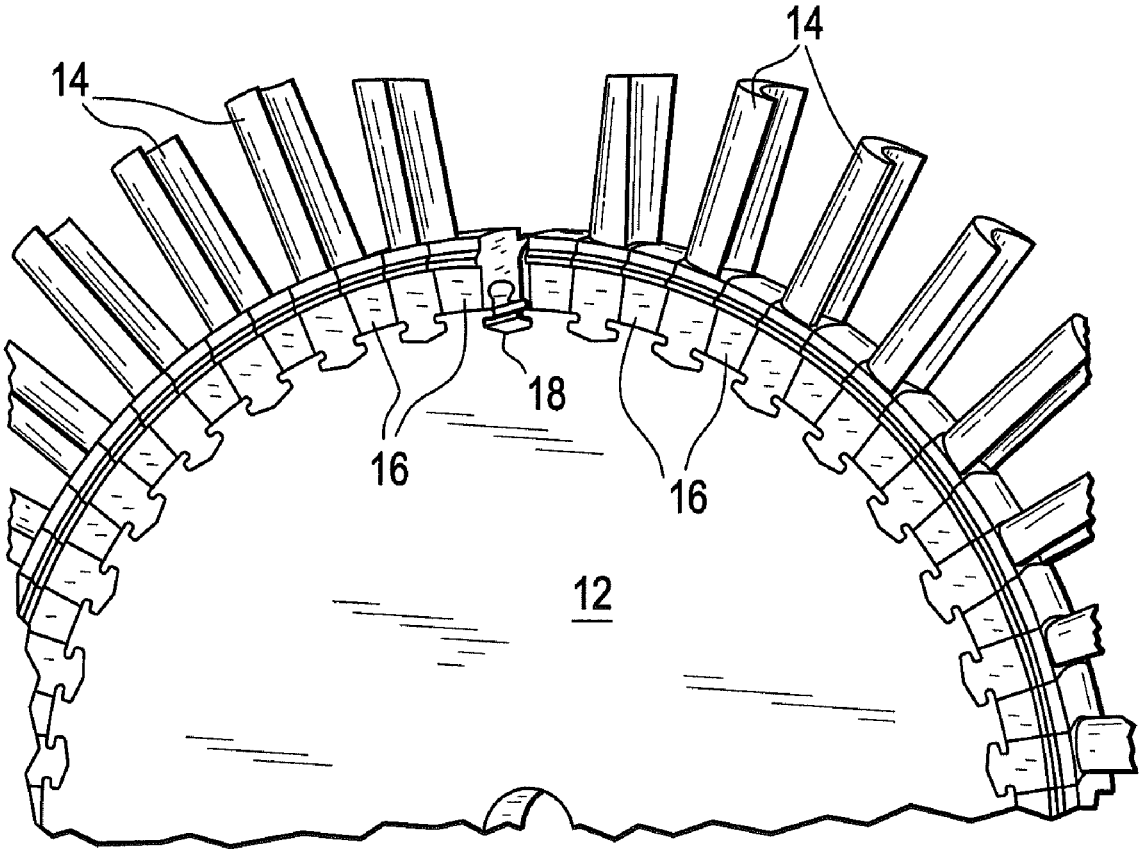
FIG. 8 is a another perspective view of a partially assembled rotor assembly of FIG. 1.
Figure 9:
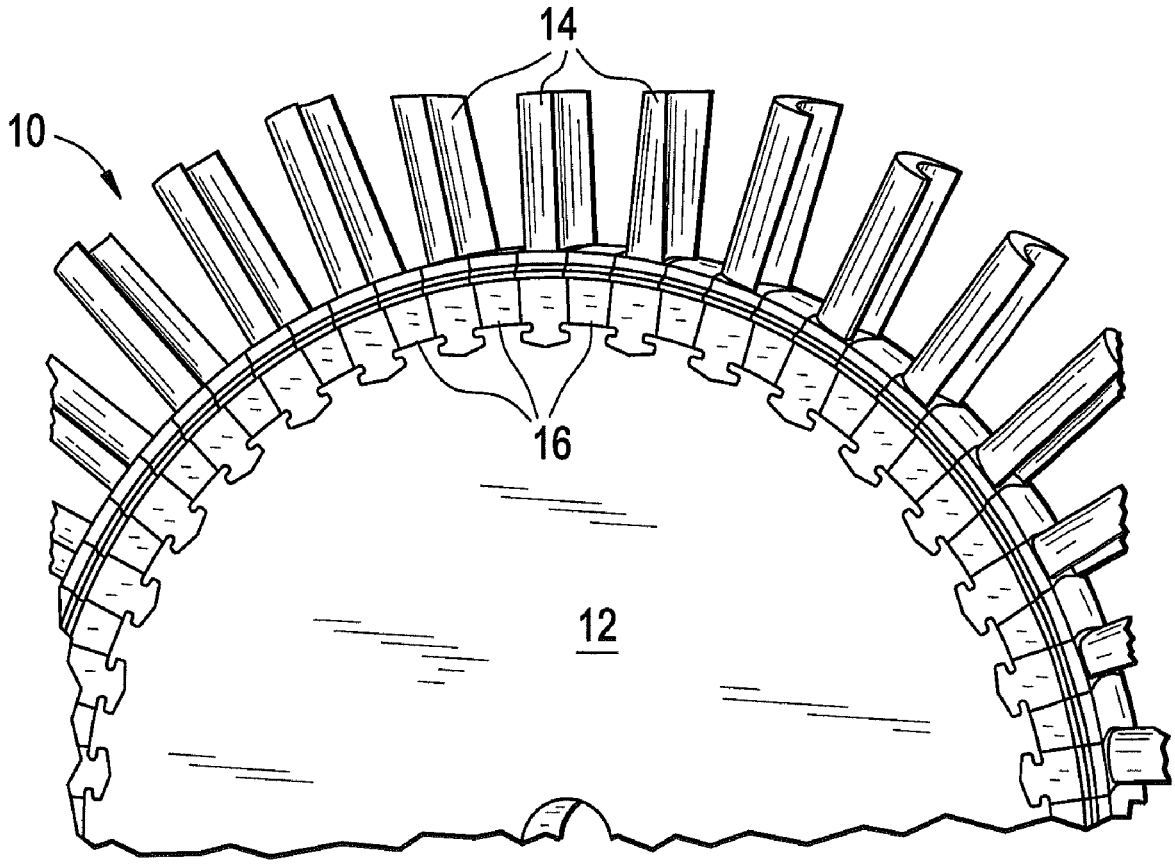
FIG. 9 is a perspective view of a rotor assembly of FIG. 1.

An embodiment of an assembly method of the rotor assembly 10 is illustrated in FIGS. 6-9. Referring to FIG. 6, initially a platform 16 is installed to the wheel 12. The platform 16 is inserted into a dovetail slot 18 in an axial direction until the platform dovetail 40 aligns with the circumferential dovetail 30. The platform 16 is then moved circumferentially so that the at least one platform tang 42 engages with the at least one circumferential tang 34. A blade 14 is then installed to the wheel 12 by inserting the blade dovetail 36 into a dovetail slot 18 adjacent to the previously installed platform 16. The blade 14 is inserted in an axial direction so the at least one blade tang 38 engages the at least one axial tang 26 and positions the blade 14 in the wheel 12. Another platform 16 is then installed in the wheel adjacent to the previously installed blade 14. Assembly of the rotor assembly 10 continues around the circumference of the wheel 12 by alternating installation of blades 14 and platforms 16 as shown in FIGS. 7 and 8. Finally, referring to FIG. 9, the rotor assembly 10 is completed by installing a blade 14 in the dovetail slot 18 between two previously installed platforms 16. Installation of the last blade 14 in the dovetail slot 18 locks the circumferential positions of the blades 14 and the platforms 16. To lock the blades 14 in an axial direction, conventional means such as lockwire and/or retention tabs may be incorporated into the assembly. Further, conventional sealing means, such as sheet metal seals and/or sealing pins may be utilized to provide sealing in the axial join between adjacent blades 14 and platforms 16 in the rotor assembly 10.

Alternatively, assembly of the rotor assembly 10 may be accomplished by initially installing a blade 14 in the wheel 12. In this method assembly proceeds by alternating installation of platforms 16 and blades 14 until the final two platforms 16 are installed on the wheel 12, leaving an opening in the wheel 12 for installation of the final blade 14. The final blade 14 is then installed as above to lock circumferential positions of the blades 14 and platforms 16.

Separation of the blade 14 and platform 16 into separate components of the rotor assembly 10 has the benefit of reducing a thermal fight that occurs in a conventional blade/platform assembly. Additionally, this solution allows the blades 14 and platforms to be fabricated from different materials, so that each may be designed and fabricated to withstand stress levels of each component. Further, separating the platform 16 from the blade 14 allows introduction of cooling schemes for the blade 14 and/or platform 16 that may not be feasible in a unitary blade/platform. Further, the platform 16 could be pocketed to reduce weight of the platform 16.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A rotor assembly for a turbomachine comprising:

a disk including a first axial face and a second axial face, the disk having:

at least one circumferential dovetail extending around an outer surface of the disk;

a plurality of axial dovetails extending from the first axial face to the second axial face;

a plurality of blades, each blade installed into an axial dovetail of the plurality of axial dovetails; and a plurality of platforms, each platform installed adjacent to a blade of the plurality of blades via the at least one circumferential dovetail.

2. The rotor assembly of claim 1 wherein each axial dovetail of the plurality of axial dovetails extends substantially parallel to a central axis of the disk from the first axial face to the second axial face.

3. The rotor assembly of claim 1 wherein each axial dovetail of the plurality of axial dovetails is curved along a length between the first axial face and the second axial face.

4. The rotor assembly of claim 1 wherein each axial dovetail includes at least one axial dovetail tang extending from a dovetail slot wall.

5. The rotor assembly of claim 4 wherein each blade of the plurality of blades includes at least one blade tang engageable with the at least one dovetail tang to secure the blade to the axial dovetail.

6. The rotor assembly of claim 1 wherein the circumferential dovetail includes at least one circumferential tang extending from a circumferential dovetail wall.

7. The rotor assembly of claim 6 wherein each platform of the plurality of platforms includes at least one platform tang engageable with the at least one circumferential tang to secure the platform to the circumferential dovetail.

8. The rotor assembly of claim 1 wherein the circumferential dovetail extends radially outwardly from the outer surface of the disk.

9. The rotor assembly of claim 1 including one or more sheet metal seals and/or seal pins disposed between adjacent blades and platforms.

* * * * *